US006343927B1

(12) United States Patent
Eroglu et al.

(10) Patent No.: US 6,343,927 B1
(45) Date of Patent: Feb. 5, 2002

(54) METHOD FOR ACTIVE SUPPRESSION OF HYDRODYNAMIC INSTABILITIES IN A COMBUSTION SYSTEM AND A COMBUSTION SYSTEM FOR CARRYING OUT THE METHOD

(75) Inventors: Adnan Eroglu, Untersiggenthal; Christian Oliver Paschereit, Baden, both of (CH); Wolfgang Polifke, Freising (DE)

(73) Assignee: Alstom (Switzerland) Ltd, Baden (CH)

( * ) Notice: Subject to any disclaimer, the term of this patent is extended or adjusted under 35 U.S.C. 154(b) by 0 days.

(21) Appl. No.: 09/625,041

(22) Filed: Jul. 24, 2000

(30) Foreign Application Priority Data

Jul. 23, 1999 (DE) ..... 199 34 612

(51) Int. Cl.[7] ..... F23C 11/00

(52) U.S. Cl. ..... 431/1; 431/12; 431/114; 239/11; 239/101; 60/39.79; 60/725

(58) Field of Search ..... 431/1, 2, 12, 18, 431/114, 280, 281; 239/589.1, 11, 101, 8, 399, 403, 405; 60/39.79, 725, 737, 747, 39.8

(56) References Cited

U.S. PATENT DOCUMENTS

| | | | | |
|---|---|---|---|---|
| 3,388,862 A | | 6/1968 | Gabrielson | |
| 3,748,852 A | | 7/1973 | Cole et al. | |
| 4,226,083 A | | 10/1980 | Lewis et al. | |
| 5,110,285 A | * | 5/1992 | Snyder et al. | 431/8 |
| 5,383,781 A | * | 1/1995 | Stouffer | 431/2 |
| 5,546,853 A | * | 8/1996 | Heil et al. | 431/2 |
| 5,957,682 A | * | 9/1999 | Kamal et al. | 431/328 |

FOREIGN PATENT DOCUMENTS

| | | |
|---|---|---|
| DE | 4241729 A1 | 6/1994 |
| DE | 4339094 A1 | 5/1995 |
| DE | 19504610 A1 | 8/1996 |
| DE | 19542918 A1 | 5/1997 |
| EP | 0309838 A1 | 4/1989 |
| EP | 0321809 B1 | 6/1989 |
| EP | 0 672 862 A2 | 9/1995 |

* cited by examiner

*Primary Examiner*—Sara Clarke
(74) *Attorney, Agent, or Firm*—Burns, Doane, Swecker & Mathis, L.L.P.

(57) ABSTRACT

A method for active suppression of hydrodynamic instabilities in a combustion system in which liquid or gaseous fuel is premixed with combustion air and the fuel/air mixture is then burnt. The mass flow of the supplied fuel is modulated on the basis of a selected time function. Simplification and increased functional reliability are achieved by the modulation which is carried out using fluidics.

15 Claims, 2 Drawing Sheets

METHOD FOR ACTIVE SUPPRESSION OF HYDRODYNAMIC INSTABILITIES IN A COMBUSTION SYSTEM AND A COMBUSTION SYSTEM FOR CARRYING OUT THE METHOD

FIELD OF THE INVENTION

The present invention relates to the field of combustion technology. It relates to a method for active suppression of hydrodynamic instabilities in a combustion system. It also relates to a combustion system for carrying out the method.

BACKGROUND OF THE INVENTION

Thermoacoustic oscillations represent a danger to all types of combustion applications. They lead to high-amplitude pressure fluctuations, to constriction of the operational range, and can increase undesirable emissions. This affects, in particular, combustion systems with little acoustic damping, such as those used in gas turbines. Active control of the combustion oscillations may be required to guarantee high performance with regard to pulsations and emissions over a wide operating range.

Various techniques for controlling and suppressing combustion instabilities by means of an active control system have already been proposed, in which, using either an open or a closed controller, the supply of fuel and/or combustion air to the burner or to the burners is controlled or modulated in a defined manner. A prior, not previously published application from the applicant relates, for example, to active control of the instabilities in a premixing burner and is illustrated, for example, in FIG. 1 of EP-B1-0 321 809. In such a premixing burner, the fuel flows in the two outer fuel lines (8, 9 in FIG. 1 of EP-B1-0 321 809) are modulated asymmetrically in an open loop at frequencies between 0.3 Hz and 5 kHz, preferably between 5 Hz and 200 Hz. The modulation process is carried out with the aid of two fuel valves which are inserted in the fuel line.

A disadvantage with the use of mechanically moving, electrically driven fuel valves is that they have mechanically moving parts which are subject to increased wear at the modulation frequencies that are used, and whose functional reliability is subject to restrictions. Another disadvantage is the power required by the valves themselves, which makes additional circuit measures necessary.

SUMMARY OF THE INVENTION

The object of the invention is thus to specify a method for active control of combustion instabilities, which is simple and functionally reliable and presents only minor requirements in terms of hardware preconditions.

The essence of the invention is to use fluidics methods rather than unreliable mechanically operated valves for modulation of the fuel supply, that is to say to vary the fuel flows by hydrodynamic means without any moving parts, by using fluidic switches and control elements.

One preferred embodiment of the method according to the invention is distinguished in that, within the combustion system, the fuel is passed to two separate fuel lines for premixing, and in that, in order to modulate the supplied fuel, the fuel mass flow is alternately split in a different manner between the two fuel lines by fluidics means. Such alternate splitting is particularly suitable for premixing burners of the type mentioned above since this advantageously results in the axial symmetry of the combustion flame being disturbed and the axial symmetrical vortex structures and pressure fluctuations associated with axial symmetry being suppressed, or their creation being prevented. The alternate splitting can, for example, be achieved by supplying a first unmodulated partial mass flow of fuel equally via the two fuel lines, while a second partial mass flow is additionally supplied alternately via one of the two fuel lines. This process does not utilize the full modulation depth in the fuel supply.

However, it is also conceivable, according to a preferred development of the embodiment, for the (entire) fuel mass flow to be passed alternately via one of the two fuel lines (full modulation depth).

The modulation process is preferably carried out using a periodic time function, at a predetermined frequency and with a predetermined amplitude. The frequencies are in this case governed by the geometry and method of operation of the combustion system, and are normally in a range which has already been mentioned further above in conjunction with the prior art.

The destruction of the symmetries in the flame or combustion chamber which promote oscillations can in this case be achieved on the one hand by the fuel being passed via the two fuel lines to a single premixing device and being injected at different points there.

However, it is also conceivable for the fuel to be passed via the two fuel lines to different premixing devices (for example premixing burners) within the same combustion system and to be injected there, which leads to symmetry suppression within the entire system comprising a plurality of premixing devices.

In the combustion system according to the invention, which comprises a premixing device for mixing the fuel with the combustion air, at least one fuel line for supplying the fuel to the premixing device, and means for modulation of the mass flow of the supplied fuel, is distinguished in that the modulation means comprise a fluidics element.

Another preferred embodiment of the combustion system according to the invention is distinguished in that the fuel is supplied via two fuel lines and in that the fluidics element is designed and is connected to the two fuel lines such that, when modulation occurs, at least a portion of the supplied fuel mass flow is switched alternately to one of the two fuel lines. In particular, the two fuel lines lead to the same premixing device, and the premixing device is designed such that the fuel from each of the fuel lines is injected at a different point in the premixing device.

The fluidics element which is used preferably comprises a fuel inlet and two fuel outlets which branch in a Y-shape from the fuel inlet and are connected to the fuel lines, and two mutually opposite control channels, which run transversely with respect to the fuel inlet, that open into the fuel inlet in the region of the branch of the fuel outlets. By applying increased pressure or reduced pressure, the element allows the fuel mass flow entering the fuel inlet to be diverted from one fuel outlet to the other.

The desired modulation is achieved in a particularly simple manner with the aid of this fluidics element if the two control channels are connected to one another in a closed circuit by means of a connecting tube of predetermined length running outside the fluidics element.

BRIEF DESCRIPTION OF THE DRAWINGS

Preferred embodiments of the invention are disclosed in the following description and illustrated in the accompanying drawings, in which.

DETAILED DESCRIPTION OF THE INVENTION

Figure 1:
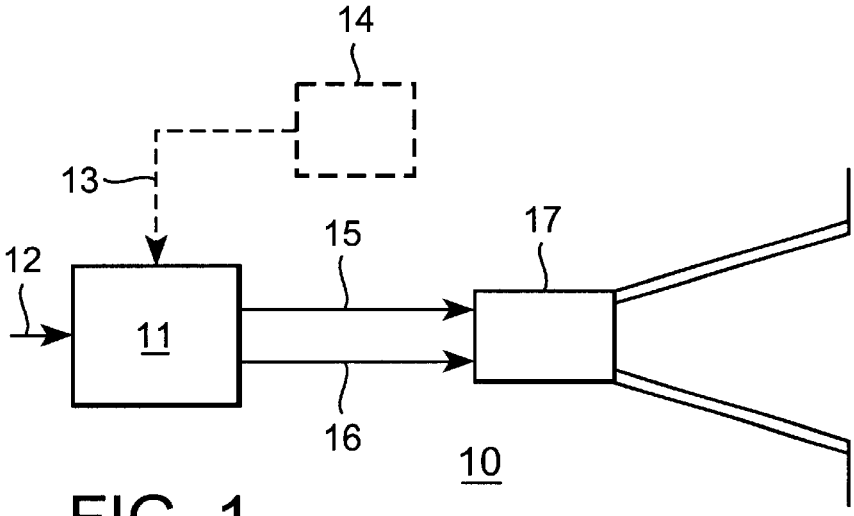
FIG. 1 shows a first exemplary embodiment of a combustion system according to the invention having a premixing burner which is supplied with fuel via two different fuel lines, modulated by means of a fluidics element.

FIG. 1 shows a first exemplary embodiment of a combustion system according to the invention. The combustion system 10 comprises a (schematically illustrated) premixing burner 17 which, by way of example, is in the form of a double-cone burner, as is shown in FIG. 1 of EP-B1-0 321 809. A (gaseous) fuel is injected on two opposite sides into the premixing burner 17, and is mixed with the required combustion air. For this purpose, the fuel for the premixing burner 17 is passed via two separate fuel lines 15 and 16, which are fed from a common fuel inlet 12 via a fluidics element 11.

Figure 4:
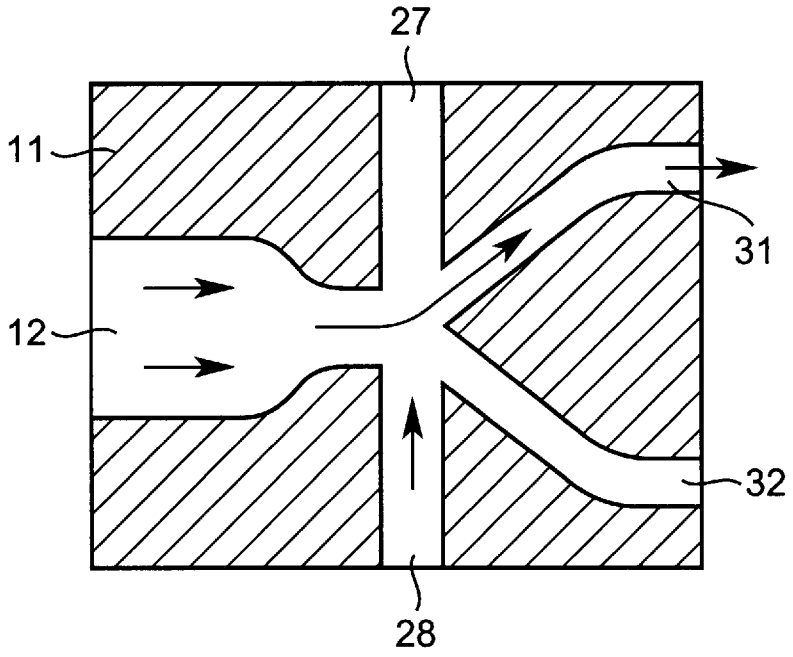
FIG. 4 shows the internal design of a fluidics element as is preferably used in the exemplary embodiments shown in FIGS. 1 to 3.

The fluidics element 11 is preferably internally designed as shown in FIG. 4 (schematically). The fuel inlet 12 branches in a Y-shape, after a constriction in the interior of the element, into two obliquely emerging fuel outlets 31 and 32, to which the fuel lines 15, 16 are connected. Two mutually opposite control channels 27 and 28 are also provided in the interior of the fluidics element, which run transversely with respect to the fuel inlet 12 and open into the fuel inlet 12 in the region of the branch of the fuel outlets 31, 32. The operation of the fluidics element 11 is based on the principle of the Prandtl diffuser and the Coanda effect. The mass flow flowing in through the fuel inlet 12 has the natural tendency to flow out through one of the fuel outlets 31, 32 owing to the Coanda effect (in FIG. 4, the arrows indicate that, in this example, the flow emerges through the upper fuel outlet 31). The fuel mass flow entering through the fuel inlet 12 can be diverted from one fuel outlet 31 to the other fuel outlet 32, and vice versa, by applying increased pressure in one control channel (27 in FIG. 4) or reduced pressure in the other control channel (28 in FIG. 4).

Thus, if the fluidics element 11 in FIG. 1 is driven from a controller 14 via a control line 13 with appropriate periodic pressure surges to the control channels 27, 28 of the fluidics element, it distributes the fuel mass flow at the fuel inlet 12 on a periodically switching basis to one of the two fuel outlets 31, 32, and thus to one of the two fuel lines 15, 16. The switching frequency and thus the modulation frequency of the fuel supply is in this case governed by the controller 14.

Figure 5:
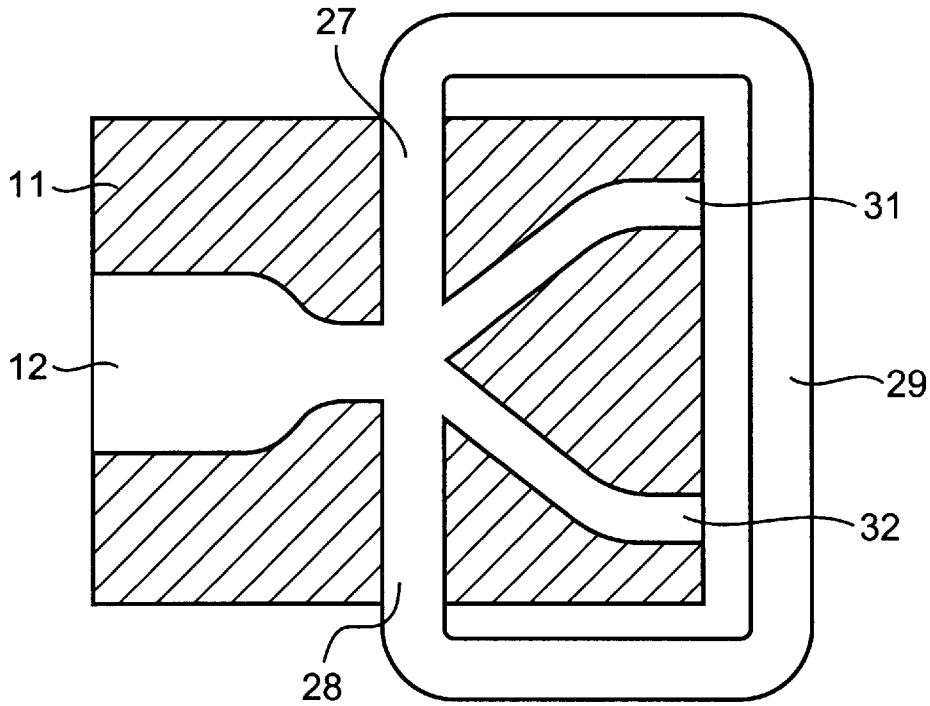
FIG. 5 shows the preferred configuration of the fluidics element from FIG. 4 as an automatically oscillating changeover element.

The modulation arrangement is particularly simple if the controller 14 (shown by dashed lines) and the control line 13 are entirely dispensed with. In this case—as shown in FIG. 5—the two control channels 27 and 28 are connected to one another externally by means of a connecting tube 29, and thus form a closed circuit. Such a configuration of the fluidics element results in automatic changeover oscillations, resulting in the flow being switched periodically between the fuel outlets 31 and 32. The geometry of the circuit, in particular the effective length of the connecting tube 29, in this case governs the changeover frequency and can be selected so as to produce an optimum modulation frequency for suppressing the combustion oscillations. The particular advantage of this arrangement is that no supply or control devices whatsoever are required for modulation.

In the example in FIG. 1, the entire fuel supply to the premixing burner 17 is modulated (100% modulation). However—as already mentioned above—within the context of the invention it is also feasible and worthwhile switching only part of the flow between the two fuel lines 15 and 16 periodically, while the rest of the fuel flow flows equally through both lines. In FIG. 1, bypass lines have been provided in a manner corresponding to this method from the fuel inlet 12 to the fuel lines 15, 16, and these bridge the fluidics element 11.

Figure 2:
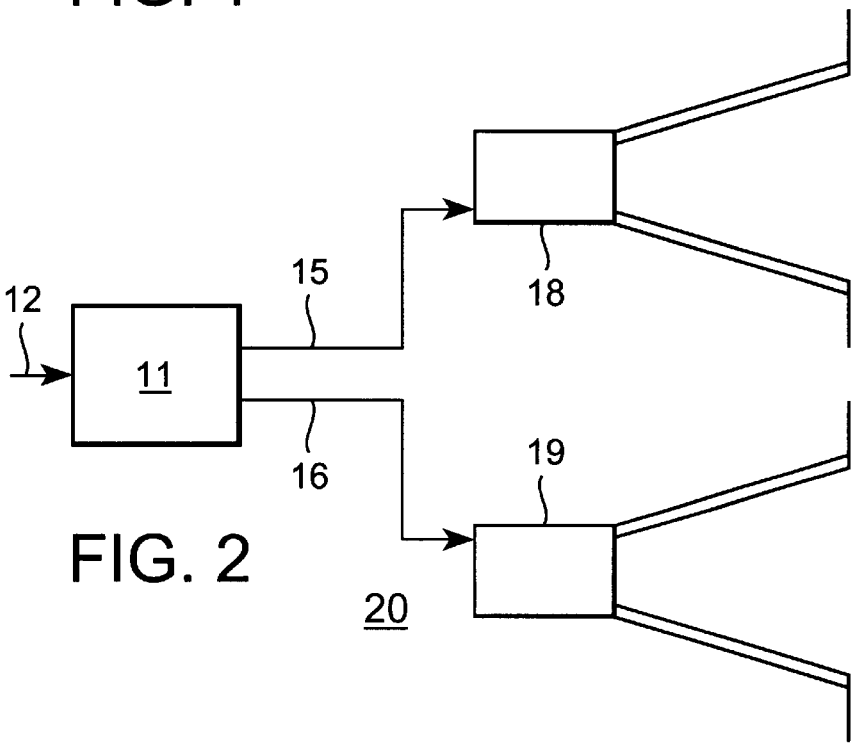
FIG. 2 shows a second exemplary embodiment of a combustion system according to the invention having two premixing burners which operate in parallel and each of which is supplied with fuel via a fuel line, modulated by means of a fluidics element.

While in the exemplary embodiment in FIG. 1, the modulation of the fuel supply itself has a disturbing influence on the symmetry in the connected premixing burner 17 as a result of the periodic process of switching backward and forward between the two fuel lines 15, 16, the desired symmetry disturbance in a combustion system 20 in which a plurality of premixing burners 18, 19 operate in parallel in one combustion chamber, it is also possible, according to FIG. 2, for the two (modulated) fuel lines 15, 16 coming from the fluidics element 11 to be connected separately to the various premixing burners 18, 19. In this case, the interaction between the two premixing burners 18, 19 prevents the formation of thermoacoustic instabilities.

Figure 3:
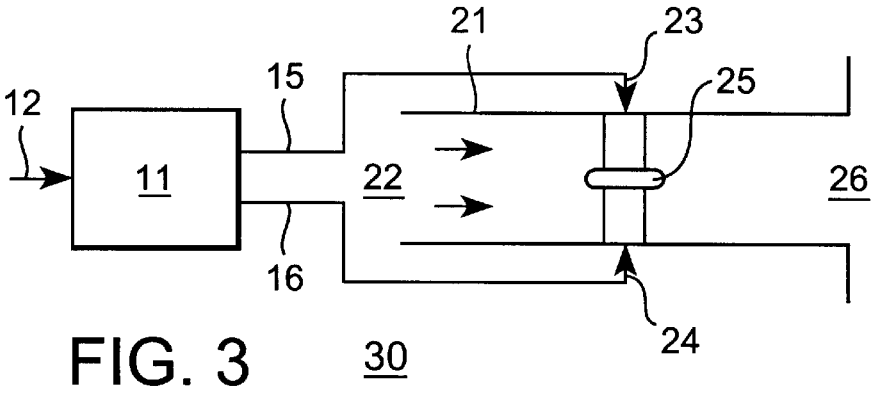
FIG. 3 shows a third exemplary embodiment of a combustion system according to the invention having a mixing tube into which fuel is injected from two opposite sides in the region of a swirl element, which fuel is supplied via two fuel lines, modulated by means of a fluidics element.

Finally, it is also feasible within the context of the invention to modulate a mixing tube 21, instead of a premixing burner, as shown in FIG. 3. In this mixing tube 21, the fuel lines 15, 16 coming from the fluidics element 11 are connected to two opposite injection apparatuses 23, 24, through which the fuel is injected in the region of a swirl element 25 arranged in the interior of the mixing tube 21, and by means of which combustion air flowing in through the air inlet 22 is mixed by vortex action. Appropriate modulation in the fluidics element 11 then results in the suppression of instabilities in the air/fuel mixture emerging through the outlet 26. The mixing tube 21 together with the swirl element 25 can in this case be designed in a similar way to that described in U.S. Pat. No. 4,226,083.

Although this invention has been illustrated and described in accordance with certain preferred embodiments, it is recognized that the scope of this invention is to be determined by the following claims.

What is claimed is:

1. A method for active suppression of hydrodynamic instabilities in a combustion system, comprising the steps of:

premixing fluid fuel with combustion air to form a fuel/air mixture;

burning the fuel/air mixture;

modulating a mass flow of the fluid fuel on the basis of a selected time function, wherein the modulation is performed using fluidics means;

passing the fuel within the combustion system to two separate fuel lines for premixing, and wherein the modulating step comprises alternately splitting the fuel mass flow between the two, separate fuel lines by the fluidics means.

2. The method as claimed in claim 1, passing the fuel mass flow alternately via one of the two fuel lines.

3. The method as claimed in claim 1, wherein the modulating step is performed using a periodic time function, at a predetermined frequency, and with a predetermined amplitude.

4. The method as claimed in claim 1, wherein the passing step comprises fuel via the two fuel lines to a single premixing device; and injecting the fuel at different points at the premixing device.

5. The method as claimed in claim 1, wherein the passing step comprises passing fuel via the two fuel lines to different premixing devices within the same combustion system, and injecting the fuel at the premixing devices.

6. A combustion system comprising:

a premixing device for mixing fuel with combustion air;

two fuel lines for supplying fuel having a mass flow to the premixing device;

means for modulation of the fuel mass flow comprising a fluidics element; and wherein the fluidics element is connected to the two fuel lines and is configured and arranged such that, when modulation occurs, at least a portion of the supplied fuel mass flow is switched alternately to one of the two fuel lines.

7. The combustion system as claimed in claim 6, comprising a plurality of premixing devices, wherein the two fuel lines lead to different premixing devices within the combustion system.

8. The combustion system as claimed in claim 7, wherein the premixing devices are premixing burners.

9. The combustion system as claimed in claim 6, wherein the two fuel lines lead to the premixing device, and wherein the premixing device is configured and arranged such that the fuel from each of the fuel lines is injected at a different point in the premixing device.

10. The combustion system as claimed in claim 9, wherein the premixing device has a main flow direction for the fuel/air mixture, and wherein the fuel which is passed via the two fuel lines is injected at mutually opposite points transversely with respect to the main flow direction.

11. The combustion system as claimed in claim 9, wherein the premixing device is a premixing burner.

12. The combustion system as claimed in claim 9, wherein the premixing device is a mixing tube.

13. The combustion system as claimed in claim 12, wherein the mixing tube has a swirl element in its interior, and comprising two opposite injection apparatuses which are directed into the mixing tube transversely with respect to the tube axis, the two opposite injection apparatuses being arranged adjacent to the swirl element.

14. The combustion system as claimed in claim 6, wherein the fluidics element comprises:

a fuel inlet;

two fuel outlets which branch in a Y-shape from the fuel inlet and are connected to the fuel lines;

two mutually opposite control channels which run transversely with respect to the fuel inlet, open into the fuel inlet adjacent to the branch of the fuel outlets and, by applying increased pressure or reduced pressure, allow the fuel mass flow entering the fuel inlet to be diverted from one fuel outlet to the other.

15. The combustion system as claimed in claim 14, further comprising a connecting tube of a length running outside the fluidics element, and wherein the two control channels are connected to one another in a closed circuit by the connecting tube.

* * * * *